US006415562B1

(12) United States Patent
Donaghue et al.

(10) Patent No.: US 6,415,562 B1
(45) Date of Patent: Jul. 9, 2002

(54) ARTIFICIAL BOARD

(75) Inventors: James C. Donaghue, Waite Park; Patrick J. Donaghue, Avon, both of MN (US)

(73) Assignee: Benchmark Outdoor Products, Inc., Sauk Rapids, MN (US)

( * ) Notice: Subject to any disclaimer, the term of this patent is extended or adjusted under 35 U.S.C. 154(b) by 0 days.

(21) Appl. No.: 09/434,621

(22) Filed: Nov. 5, 1999

Related U.S. Application Data

(60) Provisional application No. 60/107,609, filed on Nov. 9, 1998.

(51) Int. Cl.[7] ..... E04F 11/16

(52) U.S. Cl. ..... 52/177; 52/309.2

(58) Field of Search ..... 52/177, 179, 180, 52/309.2, 732.1, 630; 108/57.25, 57.28, 57.29, 901

(56) References Cited

U.S. PATENT DOCUMENTS

| | | | | | |
|---|---|---|---|---|---|
| 3,019,483 | A | | 2/1962 | Schultheiss | 18/12 |
| 3,177,279 | A | | 4/1965 | Bilodeau | 264/255 |
| 3,605,369 | A | | 9/1971 | Merrill et al. | 52/530 |
| 3,671,355 | A | | 6/1972 | Paymal | 156/324 |
| 3,935,047 | A | | 1/1976 | Shinomura | 156/163 |
| 3,993,721 | A | | 11/1976 | Soda et al. | 264/45.5 |
| 4,045,603 | A | | 8/1977 | Smith | 428/2 |
| 4,103,056 | A | | 7/1978 | Baratto et al. | 428/142 |
| 4,191,722 | A | | 3/1980 | Gould | 264/45.5 |
| 4,232,494 | A | | 11/1980 | Bauch et al. | 52/221 |
| 4,304,622 | A | | 12/1981 | Krumm | 156/500 |
| RE30,891 | E | | 3/1982 | Baratto | 482/142 |
| 4,514,950 | A | | 5/1985 | Goodson, Jr. | 52/648 |
| 4,813,193 | A | | 3/1989 | Altizer | 52/210 |
| 4,906,508 | A | | 3/1990 | Blankenburg et al. | 428/116 |
| 4,999,420 | A | | 3/1991 | Brotz | 428/288 |
| 5,075,148 | A | | 12/1991 | Biircky et al. | 428/76 |
| 5,196,255 | A | | 3/1993 | Cohen | 428/188 |
| 5,242,735 | A | | 9/1993 | Blankenburg et al. | 428/116 |
| 5,274,977 | A | * | 1/1994 | Bayly | 52/180 |
| 5,332,602 | A | | 7/1994 | Barré et al. | 428/99 |
| 5,505,141 | A | * | 4/1996 | Barber | 108/901 |
| 5,536,541 | A | | 7/1996 | Armellini | 428/33 |
| 5,624,620 | A | | 4/1997 | Turner | 264/115 |

* cited by examiner

*Primary Examiner*—Michael Safavi
(74) *Attorney, Agent, or Firm*—Brian D. Kaul; Westman, Champlin & Kelly

(57) ABSTRACT

An artificial board generally including a top portion, an open bottom, and side walls. The top portion and side walls are integrally connected to form the body of the board which has an exterior surface. Stiffening members, integrally connected to the side walls and the top portion, extend between the sides walls and increase the rigidity of the board. Integral connecting portions can be used to construct various platforms, such as those found in benches, tables, and decks. The exterior surface can be a textured surface resembling a wood grain finish.

17 Claims, 10 Drawing Sheets

ARTIFICIAL BOARD

CROSS REFERENCE TO RELATED APPLICATION

This is a utility application based on U.S. Provisional Application 60/107,609, filed Nov. 9, 1998.

BACKGROUND OF THE INVENTION

The present invention relates to artificial boards. In particular, the present invention relates to artificial boards for use in constructing platforms.

Numerous outdoor products, such as benches and tables, are constructed of wood. Due to the environmental conditions these products are subjected to, they are highly susceptible to rot and boring insects. The rate at which the wood deteriorates can be reduced by treating the wood with a preservative. However, these treatments increase the cost of the wood product and do not offer indefinite protection. Furthermore, these products are dependent upon diminishing forest reserves as a source for material.

To overcome some of these inadequacies of wood, manufacturers have substituted wood boards with extruded plastic boards. These extruded plastic boards are not susceptible to rot, decay or boring insects. As a result, they are capable of substantially outlasting their wood counterparts. In addition, these boards can be made, at least in part, from recycled plastics. However, extruded boards are generally structurally deficient, expensive, and lack the resemblance of real wood lumber.

The structural deficiency of extruded plastic boards is made evident due to the significant bowing of the board when loaded or when subjected to bending moments at the ends of the board. To overcome this lack of rigidity, platforms constructed of extruded boards must be heavily braced with support structure. As a result, benches, tables and other platforms constructed with extruded boards, are heavy due to the extensive metal support structure needed to create a solid product.

Furthermore, platforms constructed from extruded boards are expensive due to the high cost of the extruded boards and the support structure needed to support the extruded boards. One of the reasons for the high cost of the boards is due to the fact that they are solid and, therefore, use a large amount of plastic. Additional costs in the production of these boards results from problems with warping, which lowers the efficiency of production since severely warped boards are generally discarded. The metal support frame is also expensive due to the large amount of metal needed to form the frame and the labor costs associated with its construction. Also, shipping of the product is expensive due to its bulk and weight.

It is important to many consumers that the artificial boards have the appearance of real wood lumber. This is not possible with the extrusion process which generally produces boards that have a smooth surface, unless additional steps are taken to modify the surface of the board after the extrusion process is complete. Additionally, extruded boards generally have a single solid color and must be painted or veneered to resemble a wood grain surface. Even with this additional expense of doctoring the board to appear like real wood, the board would still not have the texture of real wood lumber.

There exist a need for a plastic board for use in the construction of various platforms, such as benches and tables, that overcomes the above-mentioned problems. The improved board should: (1) be stiff enough to support loads without needing an extensive support frame; (2) be relatively inexpensive; (3) reduce the cost of manufacturing various products that currently use extruded plastic boards; (4) provide a more wood-like appearance; and (5) utilize a high percentage of recycled plastic.

SUMMARY OF THE INVENTION

An artificial board generally including a top portion, an open bottom, and side walls. The top portion and side walls are integrally connected to form the body of the board which has an exterior surface. Stiffening members, integrally connected to the side walls and the top portion, extend between the sides walls and increase the rigidity of the board. Integral connecting portions can be used to construct various platforms, such as those found in benches, tables, and decks. The exterior surface can be a textured surface resembling a wood grain finish.

A feature and advantage of an embodiment of the invention is that the boards are stiff due to the integral stiffening members. These stiffening members allow the board, when supported at its ends, to sufficiently counteract bending moments produced by a load perpendicular to the top surface of the board, without bowing significantly. These loads that the artificial board is capable of supporting are many times greater than those capable of being supported by extruded plastic boards. As a result, the artificial board of the present invention requires less support structure than extruded boards along its length to prevent the sagging of the board.

Another feature and advantage of an embodiment of the invention is that the boards have integral connecting portions allowing for more efficient construction of platforms. In addition, these integral connecting portions can eliminate the need to drill holes or make other modifications to the board to construct the platform. In one preferred embodiment, the appearance of nuts and bolts on the top surface of the board is eliminated.

Yet another feature and advantage of an embodiment of the invention is that the board can be made having the dimensions of typical construction boards. In this preferred embodiment, the board takes on the appearance of typical construction wood.

Another feature and advantage of an embodiment of the invention is that the board uses less plastic than current boards. As a result, the artificial board of the present invention weighs much less than other artificial boards.

Yet another feature and advantage of an embodiment of the invention is that the boards can be customized to a specific need by adjusting the mold.

Still yet another feature and advantage of an embodiment of the invention is that the board has a relatively uniform thickness throughout. As a result, problems with warping and other defects are minimized allowing boards to manufactured within tight tolerances.

Another feature and advantage of an embodiment of the invention is that the boards can be used to create platforms having various uses. Generally, these boards are best suited for platforms that will be subjected to the outdoors. These platforms include benches, tables, chairs, terraces, decks, patios, boat docks, floating docks, tree stands, and most other outdoor platforms.

Yet another feature and advantage of an embodiment of the invention is that the boards are rot, decay and insect resistant.

Still yet another feature and advantage of an embodiment of the invention is that the boards have a wood-like appearance due to the wood grain texture of the board's surfaces. The wood-like appearance can be further enhanced by rolling a contrasting ink over the peaks of the textured surface.

Another feature and advantage of an embodiment of the invention is that the exterior surface of the board is a textured surface of words or symbols.

Yet another feature and advantage of an embodiment of the invention is that the exterior surface of the top of the board contains grooves to run water off of the board and to increase traction.

Still yet another feature and advantage of an embodiment of the invention is that the injection molded boards are cheaper to manufacture than extruded plastic boards.

Another feature and advantage of an embodiment of the invention is that platforms constructed from the boards are cheaper and superior to those constructed using extruded plastic boards found in the prior art.

Yet another feature and advantage of the invention is that it is acceptable as a furniture grade product, unlike extruded boards which are porous.

Still yet another feature and advantage of the invention is that it can be produced at approximately one fifth the cost of extruded plastic boards.

Another feature and advantage of an embodiment of the invention is that it can be made of 100% recycled plastic.

DETAILED DESCRIPTION OF THE PREFERRED EMBODIMENTS

Figure 1:
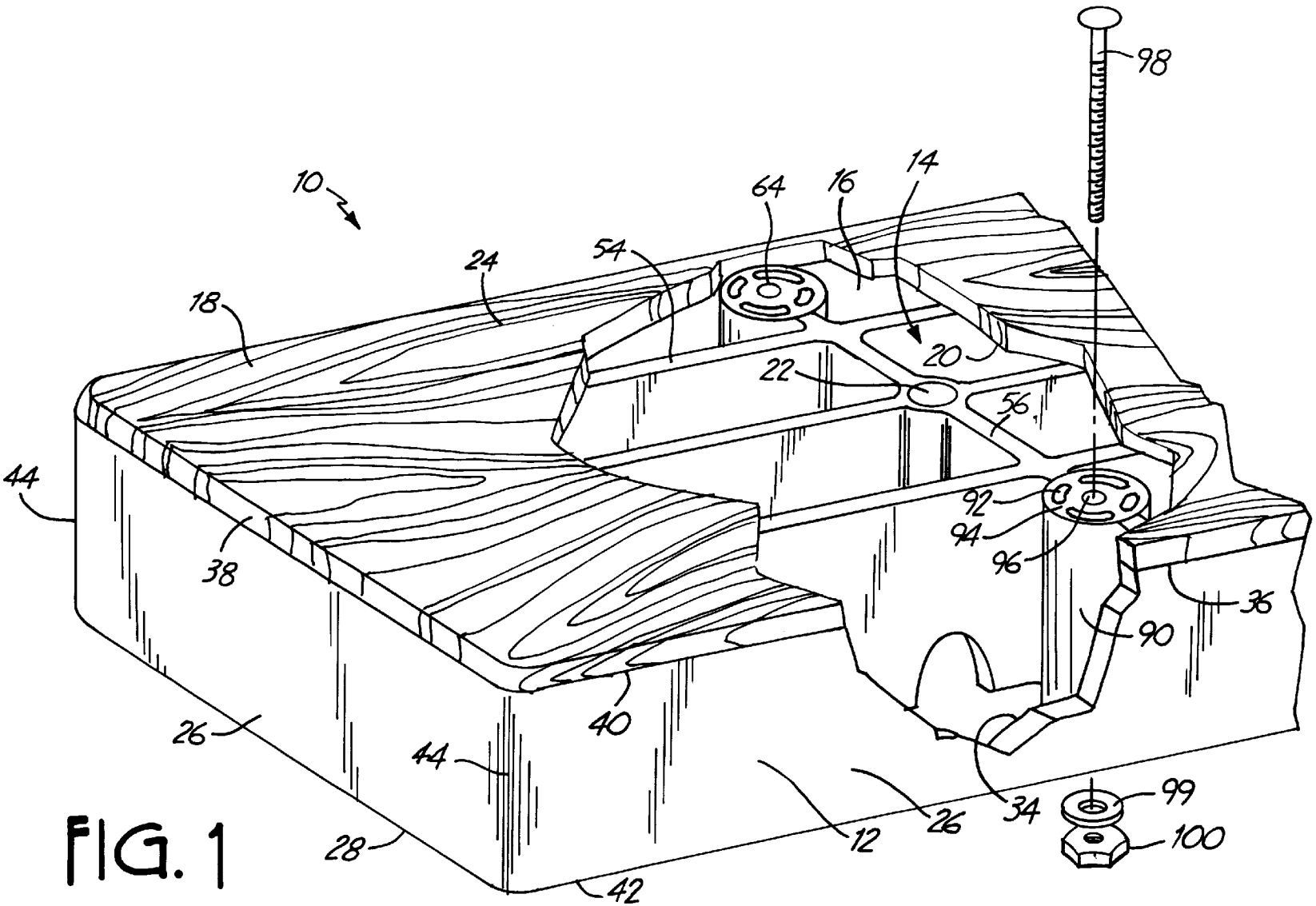
FIG. 1 is a partial perspective view of an embodiment of the invention with a portion broken away.

An artificial board, designated as 10, is shown in FIG. 1. Board 10 is formed of plastic through an injection molding process. Artificial board 10 generally comprises body portion 12, stiffening members 14, and open interior 16. Body portion 12 has an exterior surface 18 and an interior surface 20. Stiffening members 14 are integrally connected to interior surface 20 of body portion 12 within open interior 16. The combination of body portion 12 and stiffening members 14 results in a very rigid artificial board that is capable of withstanding large loads without the sagging problems associated with the current extruded plastic boards.

The mold used to create board 10 has the unique property of being easily adjustable to create the desired board length. This is accomplished through use of a single adaptable mold which is capable of producing an artificial board 10 having the largest desired dimensions. Boards 10 having smaller dimensions can be created by inserting barriers within the mold to prevent the injection of plastic into the remainder of the mold. Additionally, the mold is designed to produce a board 10 having substantially the same thickness throughout. This allows board 10 to cool evenly, thus reducing the potential for warping.

Board 10 is molded using a mix that includes recycled high density polyethylene (HDPE), a flowing agent, and colorant. In one embodiment, the mix consists of approximately 76% fractional melt HDPE, 20% high melt HDPE, 1% flowing agent, and 3% colorant. The mix temperature is preferably 400° F. Briefly, board 10 is made by injecting the mix into the mold. Once the mold is filled with the mix, the injection of mix continues for another few seconds to pack the mold. Finally, the mold is cooled to a temperature of 100° F. before removing board 10 from the mold using ejection pin bosses 22.

Body portion 12 comprises a top portion 24 (or top) and side walls 26. Top portion 24 includes an exterior surface 25, an interior surface 20, lengthwise edges 36, and widthwise edges 38. One embodiment of top portion 24 is 0.250" thick. Side walls 26 include an exterior surface 32, an interior surface 34, a top edge 40, a bottom edge 42, and vertical edges 44. Side walls 26 can be tapered from top edge 40 to bottom edge 42 to facilitate the removal of board 10 from the mold. In one embodiment, side walls 26 are 0.250" at the top and taper to 0.200" at bottom edge 42. FIG. 1 shows one embodiment of body portion 12 where top portion 24 is a horizontal planar member and side walls 26 are vertically oriented planar members. Top edges 40 of side walls 26 are integrally connected to top portion 24 at lengthwise edges 36 and widthwise edges 38 and side walls 26 are integrally connected to each other at adjacent vertical edges 44 to form body portion 12. The side walls 26 that connect to top portion 24 along widthwise edges 38 are defined as opposing end walls.

Figure 2:
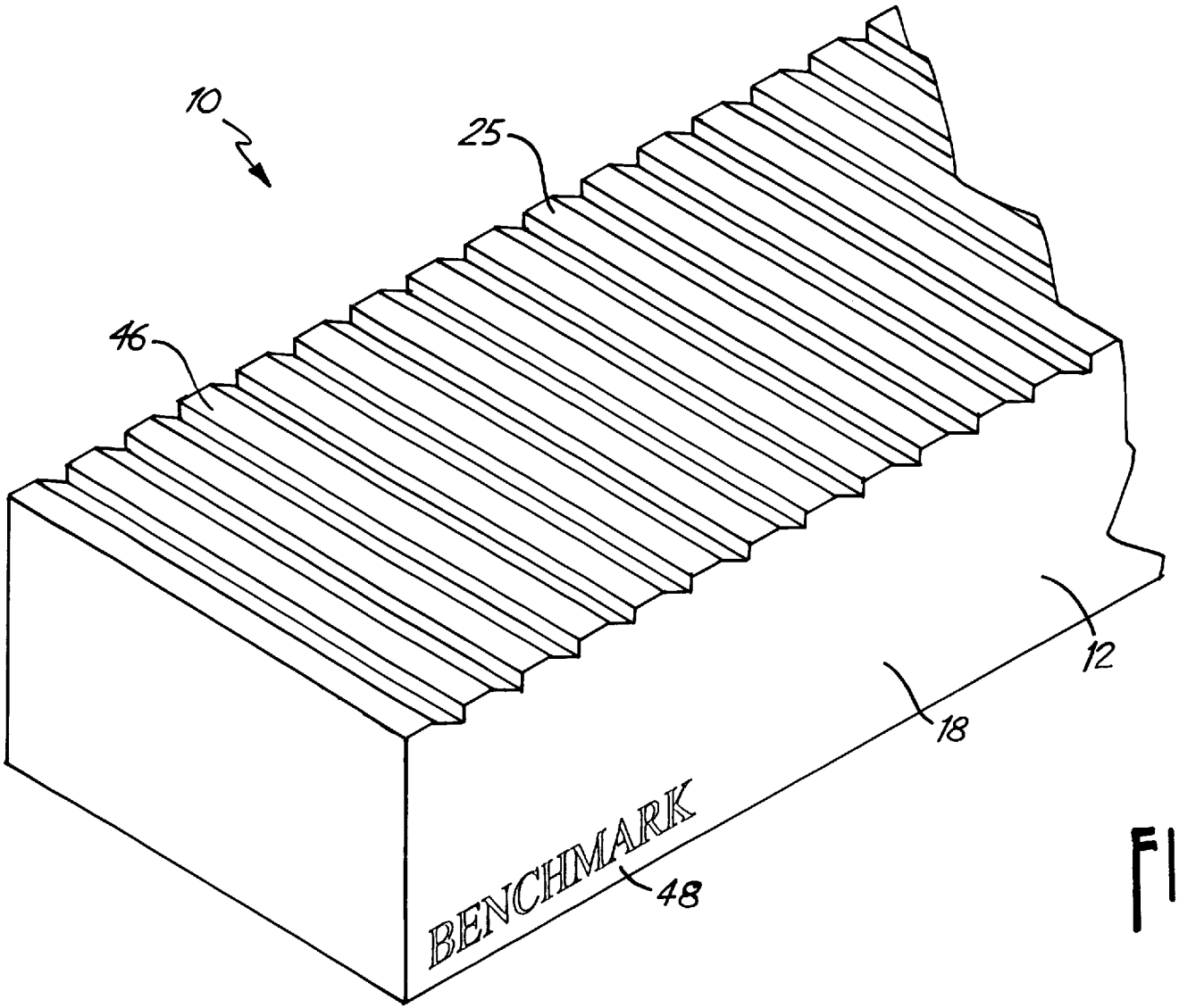
FIG. 2 is a partial perspective view of an embodiment of the invention.

It is preferred that at least a portion of exterior surface 18 of body portion 12 be a textured surface. The texturing of exterior surface 18 of body portion 12 is accomplished during the injection molding process and does not require further processing after board 10 is removed from the mold. Preferably, exterior surface 18 of body portion 12 is textured to resemble a wood grain finish as shown in FIG. 1. FIG. 2 shows another embodiment of exterior surface 18, where the portion of exterior surface 18 of body portion 12 which corresponds with exterior surface 25 of top portion 24 is textured to have grooves 46 which serve the purposes of running water off the top of board 10 and providing a non-slip surface. Additional embodiments for the texturing of exterior surface 18 include lettering 48, as shown in FIG. 2, or various artistic designs. It is envisioned that many other textures could be used alone or in combination with those described above on exterior surface 18 of body portion 12 to convey information or to add to the aesthetics of board 10.

Figure 3:
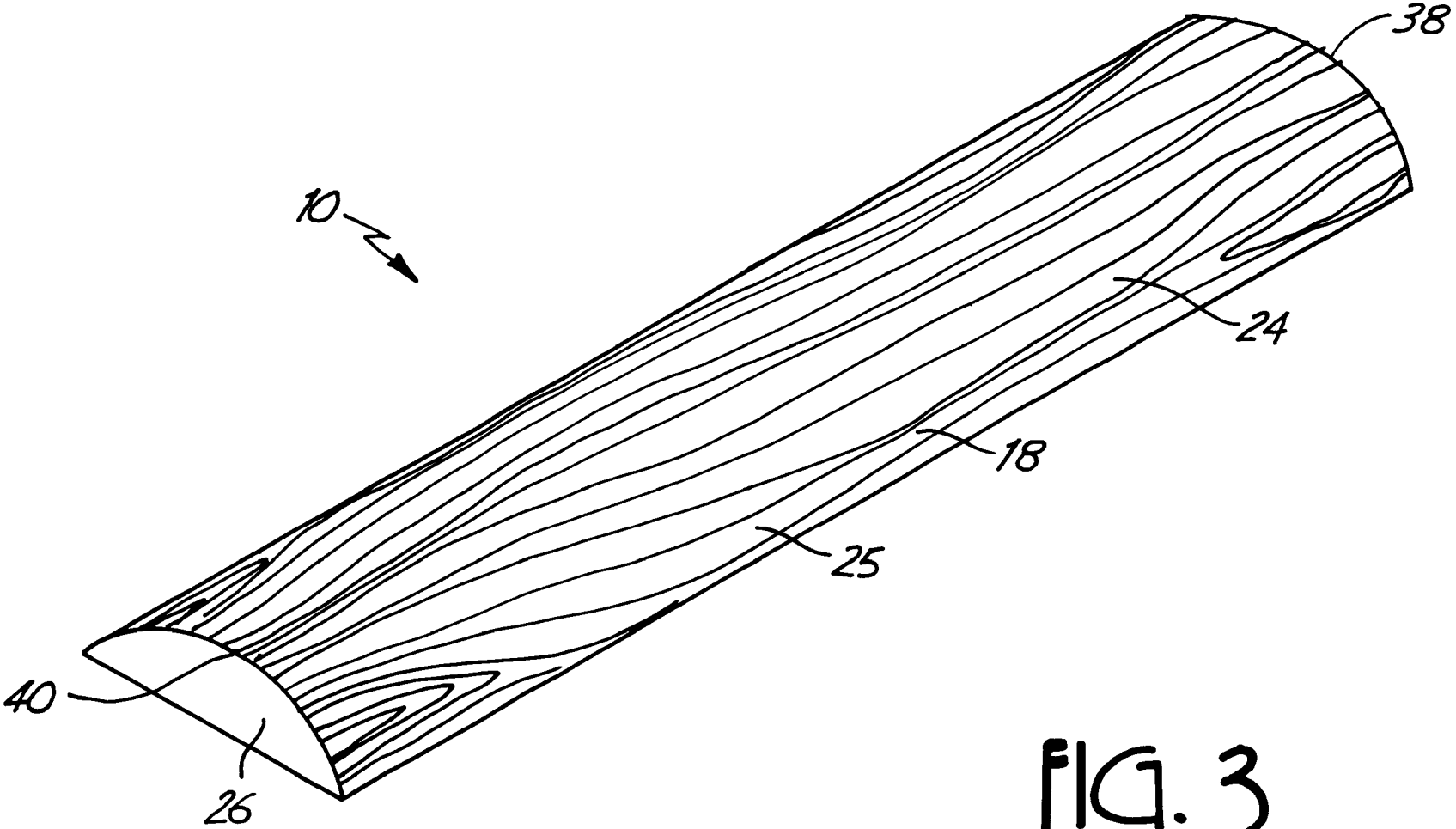
FIG. 3 is a partial perspective view of an embodiment of the invention.

In another embodiment of the invention, body portion 12 resembles a wooden log as shown in FIG. 3. In this embodiment top portion 24 is a curved planar member shaped to form a partial cylinder. The top edge 40 of side walls 26 conforms to the curvature of widthwise edges 38 of top 24. Exterior surface 18 of top portion 24 and corresponding exterior surface 18 of body portion 12 are textured to resemble the surface of a wooden log. The texture could be of a log either with or without its bark.

Figure 4:
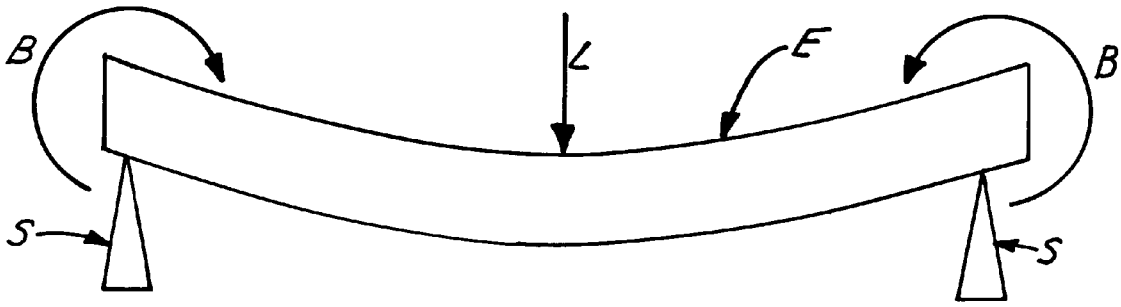
FIG. 4 is an illustration of loading an extruded plastic board found in the prior art.
Figure 5:
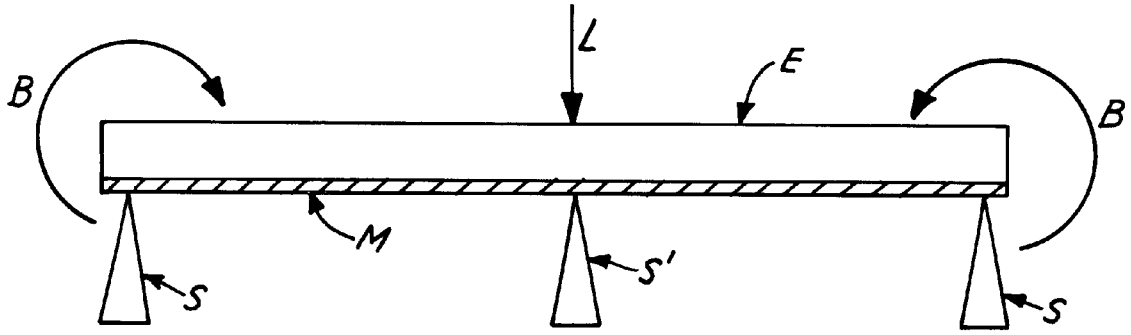
FIG. 5 is an illustration of an extruded plastic board supported by support structure to prevent bowing when loaded.

FIG. 4 shows how an extruded plastic board E supported with supports S reacts to a load L causing it to bend or sag significantly. As a result, extruded plastic boards must be braced along their length with bracing material M or additional supports S' must be used to support the extruded board as shown in FIG. 5. To overcome this bowing problem, the present invention utilizes stiffening members 14, best shown in FIG. 1, which act to increase the stiffness of board 10. As a result, board 10 is capable of supporting many times the load that a typical extruded board is capable of supporting without significant sagging. Furthermore, board 10 uses less plastic than extruded plastic boards due to hollow compartments 50, which are accessible from bottom 28 resulting in a much lighter board.

Stiffening members 14 can be tapered from top to bottom 28 to facilitate the easy removal of board 10 from the mold. In one embodiment, stiffening members 14 are 0.250" at top portion 24 and taper to 0.200" at bottom 28. In one embodiment, stiffening members 14 intersect forming a cross pattern within open interior 16, as shown in FIG. 1. In this embodiment, a first set of substantially parallel stiffening members 54 crosses a second set of substantially parallel stiffening members 56. Both sets of stiffening members 54 and 56, are integrally connected to interior surface 20 of top portion 24 and interior surface 34 of side walls 26. Other configurations for stiffening members 14 include having one set of substantially parallel stiffening members 14 extend between side walls 26 at an acute angle, preferably 45° relative to one of the side walls 26, and integrally connect to interior surface 20 of top portion 24 and interior surface 34 of side walls 26. In this embodiment it is not necessary to have a second set of stiffening members 56 to provide sufficient stiffening of board 10.

Figure 6A:
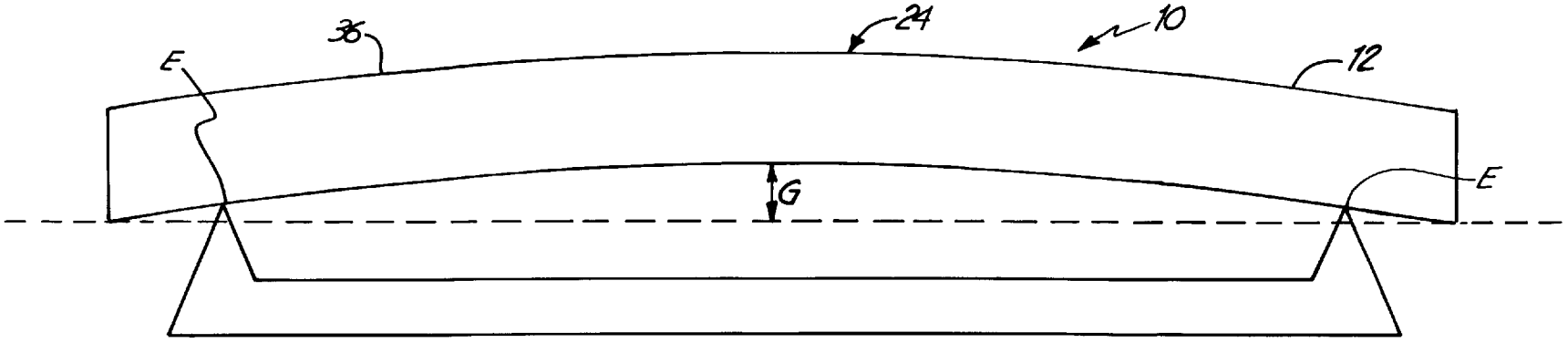
FIGS. 6*a* and 6*b* show simplified front and side views, respectively, of an embodiment of the invention.

FIG. 6*a* shows a simplified front view of another embodiment of board 10. In this embodiment, body portion 12 is molded such that it is curved about an axis running perpendicular to lengthwise edges 36 of top portion 24 and extending through the center of body portion 12. As a result, top portion 24 is curved upward and side walls 26, that are adjacent to lengthwise edges 36, are bowed to conform to the curve of top portion 24 resulting in a gap G between bottom edge 42 when board 10 is laid on a flat surface (dashed line). In one embodiment, top portion 24 of board 10 has a convex stabilization ratio of approximately 0.03 inch per lineal foot resulting in a gap G of approximately 3/16 of an inch at the center of board 10. The convex shape of board 10 produces a spring-like resistance to a load placed on top portion 24 thereby reducing the susceptibility of board 10 to sagging. In addition, when supported near its ends E with a support S such that the position of supported ends E are fixed relative to each other, the spring-like resistance of board 10 to a load placed on top portion 24 is significantly increased. As a result, this embodiment of board 10 can significantly increase its loading capabilities.

Figure 6B:
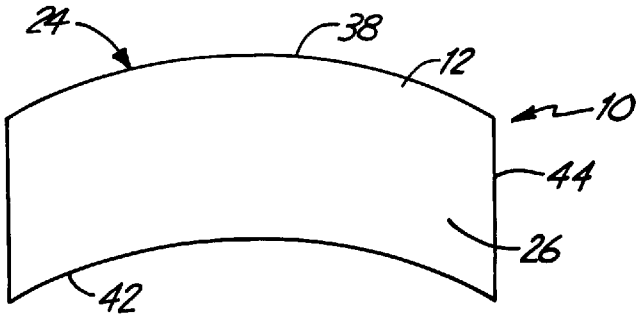

FIG. 6*b* shows a simplified side view of another embodiment of board 10 where body portion 12 is curved about an axis running perpendicular to widthwise edges 38 of top portion 24 and extending through the center of board 10. As with the above-described embodiment, the curving of board 10 in this manner can increase its loading capabilities. The loading capabilities of board 10 can be further increased by combining this embodiment of board 10 with the embodiment of board 10 shown in FIG. 6*a*.

Figure 7:
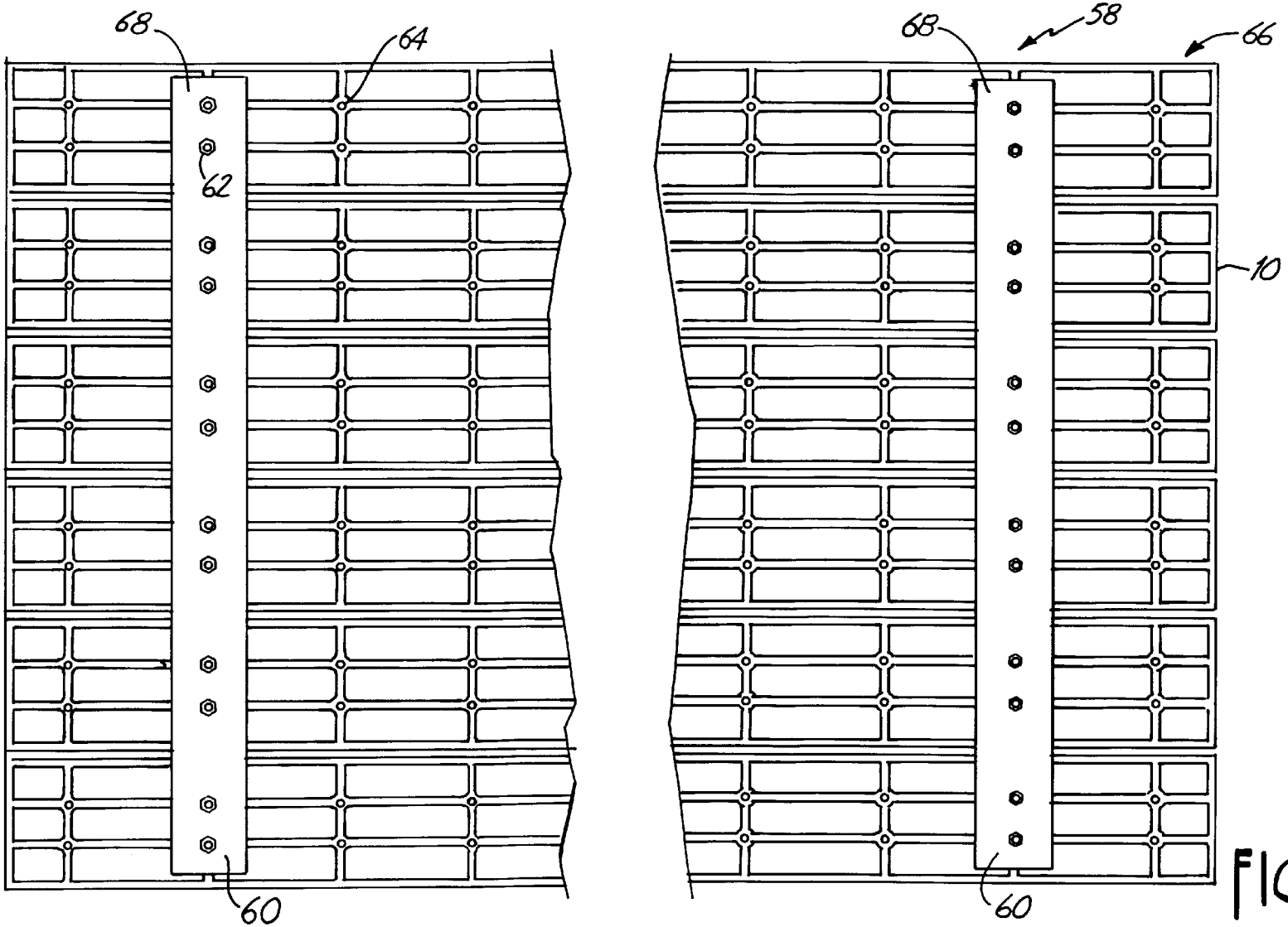
FIG. 7 is a partial bottom view of an embodiment of a platform by the invention.
Figure 8:
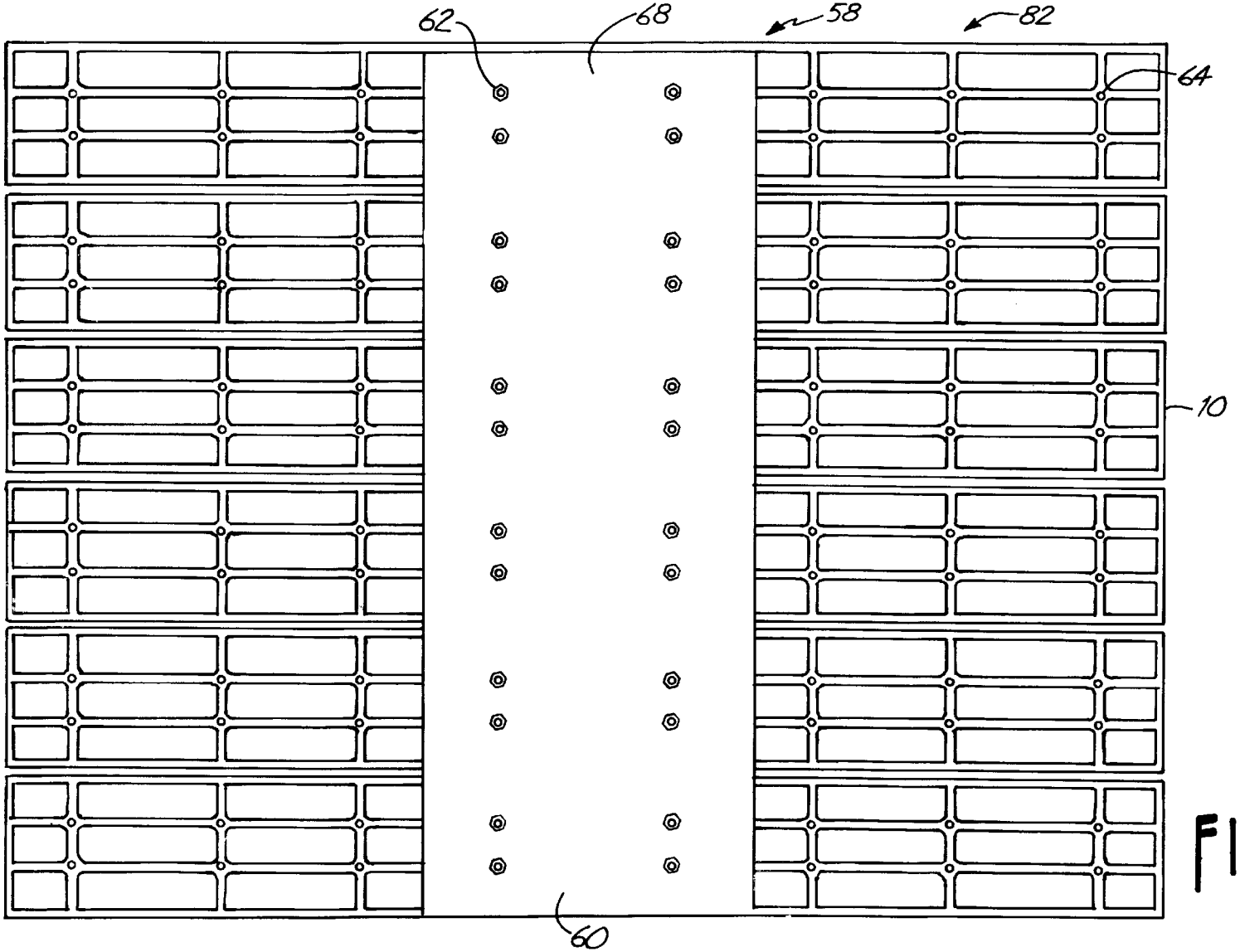
FIG. 8 is a partial bottom view of an embodiment of a platform formed by the invention.

Artificial board 10 can be used in the construction of various platforms 58 shown in FIGS. 7 and 8. Platforms 58 are commonly found as elements of objects, such as benches, tables, chairs, decks, patios, boat docks, floating docks, tree stands, ramps, and many other objects. Each platform 58 includes a support surface 59 and generally comprises a plurality of boards 10 and a support structure 60. Support structure 60, can have connecting portions 62, preferably configured as apertures which correspond to connecting portions 64 of board 10. Connecting portions 64 can be used to attach boards 10 to support structure 60 such that boards 10 are maintained in a fixed relation. Generally support structure 60 will lie transverse to the longitudinal axis of the boards 10 to maintain boards 10 in parallel alignment with respect to each other. If extruded boards were substituted with boards 10 to form platform 58, additional support structure 60 would have to be used to prevent the extruded boards from bending. As a result, platforms 58 constructed using boards 10 can weigh significantly less than those constructed using extruded plastic boards. Furthermore, platforms 58 constructed using boards 10 can be less costly and easier to manufacture than those constructed using extruded plastic boards.

One embodiment of platform 58 is platform 66 shown in FIG. 7 (bottom view). For this platform, support structure 60, consisting of two support members 68 depicted as rigid planar members or steel plates, is used to maintain boards 10 extending between support members 68 in a fixed and generally parallel relation. In another embodiment, an additional support member 68 (not shown) can be added to support structure 60 that connects the two support members 68, shown in FIG. 7, and fixes their position relative to each other. This embodiment of support structure 60 is particularly advantageous when used to fix the relative position of ends E of a boards 10 that are bowed upward, due to the increased loading capability of the resulting platform 58. Support members 68 can have connecting portions 62 which correspond with the connecting portions 64 of boards 10 allowing for easy construction of platform 58. Although platform 66 is depicted has being comprised of several boards 10, it is possible to create platform 66 using a single board 10 that is suitably sized, thereby eliminating the need for support structure 60.

Figure 9:
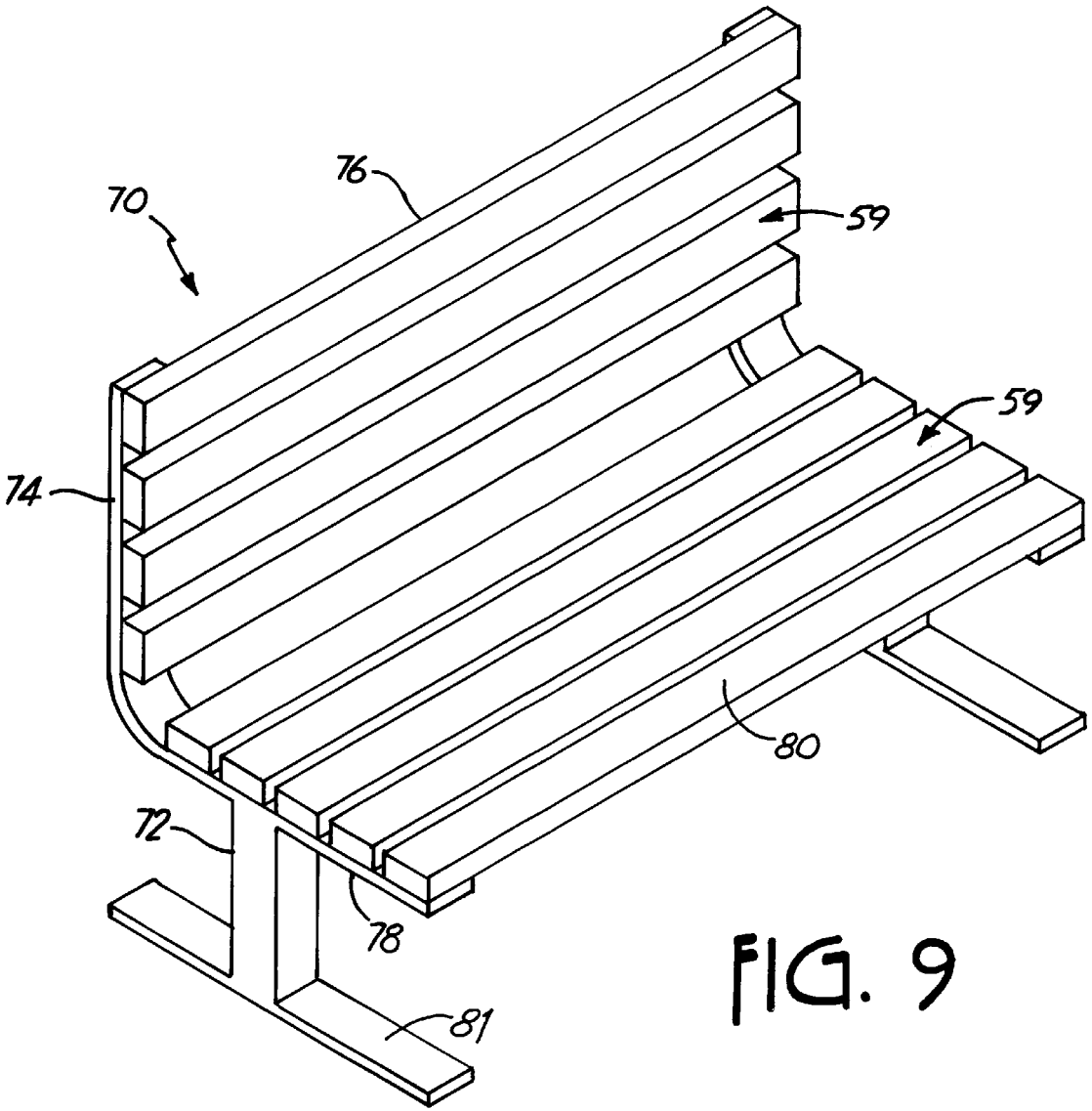
FIG. 9 is a perspective view of a bench constructed from an embodiment of the invention.
Figure 10A:
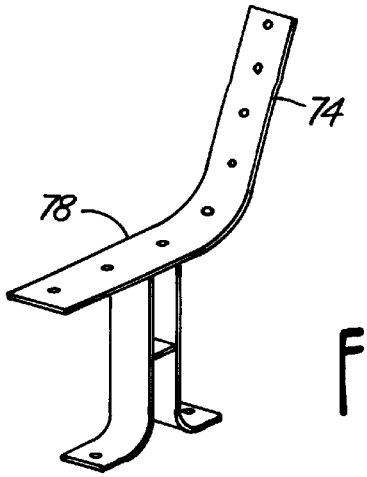
FIGS. 10*a–c* are perspective views of support structure for a bench.
Figure 10B:
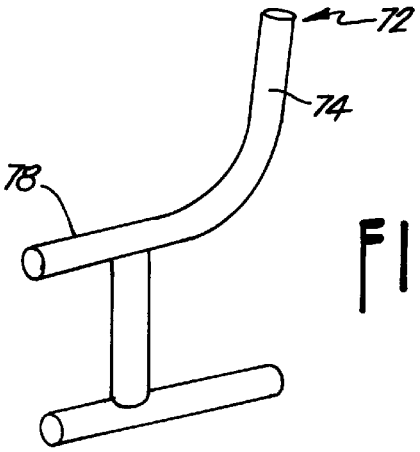
Figure 10C:
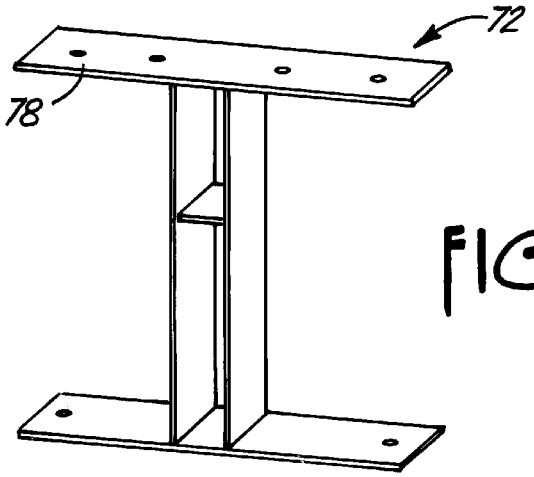

In addition to many other objects, platform 66 could be used to construct bench 70 shown in FIG. 9. Bench 70 comprises two pieces of support structure 60 configured as platform support members 72 each having a vertical support portion 74 which acts to support vertical platform 76, a horizontal support portion 78 which acts to support horizontal platform 80, and a base portion 81 which acts as a leg of the bench. Bench 70 could also be formed without vertical platform 76 by eliminating vertical support portion 74 of support members 72. Other platform support members 72 commonly used to form benches 70 are shown in FIGS. 10*a*–10*c*. Additionally, support members 72 can be connected together to fix their positions relative to each other. Benches 70 utilizing extruded plastic boards generally require an additional platform support member 72 in the middle of horizontal platform 80 and vertical platform 76 to prevent the extruded boards from sagging when loaded. As a result, benches 70 using extruded plastic boards are much heavier, take more time to construct, and are costlier than those constructed with boards 10.

Another embodiment of platform 58 is platform 82 depicted in FIG. 8. Platform 82 uses a single support member 68 generally connecting boards 10 together at their middle sections. In this embodiment, boards 10 are allowed to extend beyond support member 68 a distance which would not cause boards 10 to sag significantly when submitted to foreseeable loads at their ends. Each board is secured to support member 68, preferably in two locations, using connecting portions 62 of support structure 60 and connecting portions 64 of board 10. As with platform 66, it would be possible to construct platform 82 using a single board 10 provided that it was suitably sized.

Figure 11:
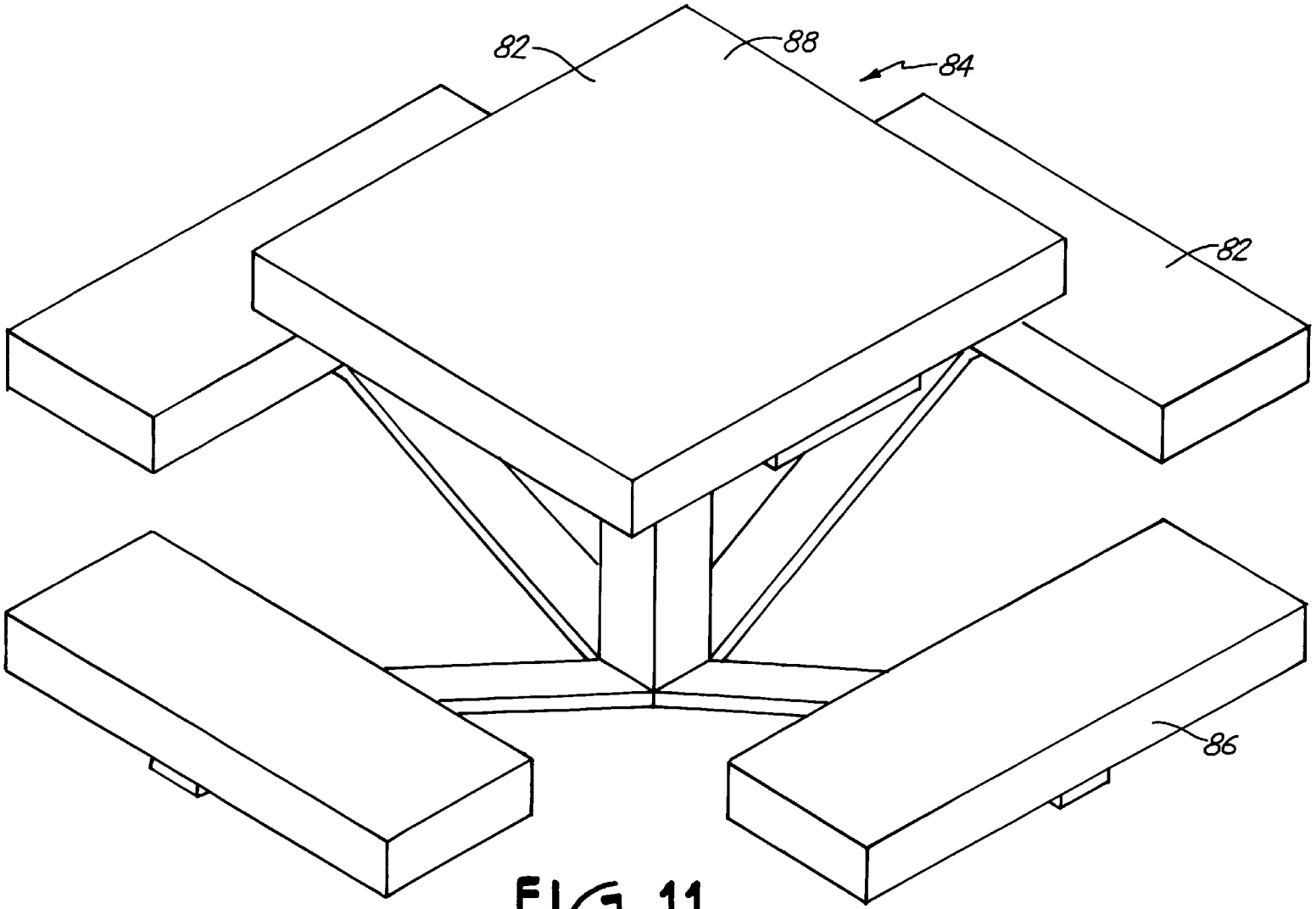
FIG. 11 is a perspective view of a picnic table constructed from an embodiment of the invention.

An example of an object created using platforms 82 is picnic table 84 depicted in FIG. 11 (individual boards 10 not shown). Picnic table 84 consists of several horizontal platforms 82; four used as benches 86 and one used as table top 88. Support structure 60, configured as a pedestal which is anchored to the ground and four branch members, maintains platforms 82 in the fixed relation shown in FIG. 11. Constructing picnic table 84 with extruded boards would require more support structure 60 to prevent the bending of the boards when loaded resulting in a heavier and more costly product.

Board 10 includes connecting portions 64 used to assist in the assembly of various platforms such as platforms 58, such as platforms 66 and 82. One or several connecting portions 64 may be integrated with board 10 depending on the use for the board. One embodiment of connecting portion 64, shown in FIG. 1, comprises connector housing 90 integrally connected to stiffening member 14 and extending from bottom 28 to top portion 24. Connector housing 90, has cooling apertures 92, fins 94, and bore 96. Apertures 92 allow connecting portion 64 to cool evenly by maintaining a substantially constant thickness throughout connector housing 90, thereby reducing the potential for any warping. Fins 94 provide additional rigidity and strength to connecting portion 64. Bore 96 extends from bottom 28 through top portion 24. Connecting board 10 to support structure 60 involves inserting bolt 98 through bore 96 and support structure 60 and securing with washer 99 and nut 100. The end of bolt 98 can be pinched off to prevent the disassembly of board 10 and support structure 60.

A second embodiment of connecting portion 64 (not shown) modifies the first embodiment of connecting portion 64 by preventing bore 96 from extending through exterior surface 18 of top portion 24, thereby eliminating the holes on exterior surface 18 of top portion 24. Connecting of board 10 to support structure 60 then requires the insertion of a suitably sized screw or expandable connector through the appropriate connecting portion 62 of support structure 60 and into bore 96 of connecting portion 64 from bottom 28 of board 10. As a result, exterior surface 18 of top portion 24 shows no sign of the means used to connect board 10 to support structure 60.

A third embodiment of connecting portion 64 (not shown) involves over-molding a connector within connector housing 90. The integral connector could be a carriage bolt having a head and a threaded portion which extends out of bottom 28 of board 10. Board 10 could then be connected to support structure 60 by inserting the exposed threaded end 79 of the carriage bolt through the corresponding connecting portion 62 of support structure 60 and securing the parts together with a nut. Further embodiments for the connector include pegs, male or female cooperating or locking connectors, and many other suitable connectors for fastening boards 10 to support structure 60, which could be other boards 10, to form the desired platform.

Although the present invention has been described with reference to specific embodiments of an artificial board 10 and platforms 58 constructed therewith, workers skilled in the art will recognize that changes may be made in form and detail without departing from the spirit and scope of the invention, which are defined by the appended claims. Thus, the present invention may be embodied in other specific forms without departing from the spirit or essential attributes thereof, and it is therefore desired that the various embodiments be considered in all respects as illustrative and not restrictive.

What is claimed is:

1. An artificial board comprising:

a body portion having an exterior surface, a top, a pair of opposing side walls, a pair of opposing end walls, an open bottom, and an open interior; the distance between the side walls defining a width and the distance between the top and the open bottom defining a depth of the board;

a plurality of first stiffening members positioned within the open interior and extending between the opposing side walls;

at least one second stiffening member positioned within the open interior and extending between the opposing end walls; and at least one connecting portion integrally connected to at least one of the body portion, the first stiffening members, and the second stiffening member to facilitate the attachment of the board to a support structure, the connecting portion including a vertically oriented column extending from the open bottom of the body portion toward the top, the column having an outer surface, an inner surface, and fins extending from the inner surface to the outer surface, each connecting portion further having cooling apertures positioned adjacent the fins and between the inner and outer surfaces; the inner surface of the connecting portion being a cylindrical surface forming a bore which extends through the top of the body.

2. The artificial board of claim 1, wherein the width and depth of the board are sized as conventional, graded wooden lumber.

3. The artificial board of claim 1, wherein a portion of the exterior surface of the body portion is a textured surface.

4. The artificial board of claim 3, wherein the textured surface resembles wood grain.

5. The artificial board of claim 3, wherein the textured surface comprises a plurality of grooves on the top of the body.

6. The artificial board of claim 1, wherein the body portion is curved about an axis running perpendicular to the side walls.

7. The artificial board of claim 6, wherein the body portion is curved about an axis running perpendicular to the end walls.

8. The artificial board of claim 1, wherein the body portion is curved about an axis running perpendicular to the end walls.

9. A platform comprising:

a plurality of the artificial boards of claim 1; and a support structure attached to the plurality of artificial boards, whereby the support structure maintains the plurality of artificial boards in a fixed relation.

10. The platform of claim 9, wherein the support structure includes apertures which align with the connecting portions of the artificial boards.

11. The platform of claim 9, wherein the support structure consists of a single rigid member.

12. The platform of claim 9, wherein the support structure consists of a plurality of rigid members.

13. The platform of claim 9, wherein at least one of the artificial boards is curved to resist sagging when loaded.

14. An injection molded artificial board comprising:

a top portion having opposing lengthwise edges, opposing widthwise edges, an exterior surface, and an interior surface;

a pair of opposing side walls each having a top edge, a bottom edge, a pair of opposing vertical edges, an exterior surface, and an interior surface; the top edge of one side wall integrally connected adjacent to and parallel with one of the lengthwise edges of the top portion and the top edge of the other side wall integrally connected adjacent to and parallel with the other lengthwise edge of the top portion;

a pair of opposing end walls each having a top edge, a bottom edge, a pair of opposing vertical edges, an exterior surface, and an interior surface; the top edge of one end wall integrally connected adjacent to and parallel with one of the widthwise edges of the top portion and the top edge of the other end wall integrally connected adjacent to and parallel with the other widthwise edge of the top portion; the vertical edges of each end wall integrally connected adjacent to and parallel with the corresponding vertical edges of the side walls; the top portion, side walls, and end walls form a body portion having an exterior surface, an open interior, a top corresponding with the exterior surface of the top portion and a bottom opposite the top from which the open interior can be accessed; the distance between the top edge and the bottom edge of each end wall defining the depth of the board and the distance between the vertical edges of each end wall defining the width of the board;

a first set of stiffening members positioned within the open interior and extending between and integrally connected to the interior surfaces of the opposing side walls and the interior surface of the top portion;

a second set of stiffening members positioned within the open interior and extending between and integrally connected to the interior surfaces of the opposing end walls, and the interior surface of the top portion, the second set of stiffening members intersecting the first set of stiffening members at intersection points, the first and second sets of stiffening members integrally connected at the intersection points; and at least one connecting portion positioned proximate the open interior, each connecting portion comprising a vertically oriented column which extends from the bottom of the body portion toward the top of the body portion, each column having an outer surface, an inner surface, and fins extending from the inner surface to the outer surface, each connecting portion further having cooling apertures positioned adjacent the fins and between the inner and outer surfaces; the inner surface of the connecting portion being a cylindrical surface forming a bore which extends through the top portion, whereby the board can be secured to a support structure by inserting a fastener into the bore of the connecting portion and into a corresponding connecting portion of the support structure.

15. The artificial board of claim 14, wherein the board is curved about an axis running perpendicular to the side walls.

16. The board of claim 14, wherein at least a portion of the exterior surface of the body portion is a textured surface.

17. The board of claim 16, wherein the textured surface resembles wood grain.

* * * * *